United States Patent [19]

Roccaforte

[11] 4,355,757

[45] Oct. 26, 1982

[54] VENTING CARTON AND BLANK THEREFOR

[75] Inventor: Harry I. Roccaforte, Western Springs, Ill.

[73] Assignee: Champion International Corporation, Stamford, Conn.

[21] Appl. No.: 240,924

[22] Filed: Mar. 5, 1981

[51] Int. Cl.[3] ..... B65D 5/22; B65D 5/35; B65D 5/36

[52] U.S. Cl. ..... 229/33; 229/23 A; 229/41 B; 229/DIG. 14

[58] Field of Search ..... 229/33, 23 A, 30, 41 B, 229/16 R, 16 C, DIG. 7, DIG. 14, 29 F

[56] References Cited

U.S. PATENT DOCUMENTS

| | | | |
|---|---|---|---|
| 2,076,844 | 4/1937 | Holmes | 229/16 R |
| 2,302,919 | 11/1942 | Snider | 229/41 B |
| 3,094,264 | 6/1963 | Petrone | 229/30 |
| 3,659,773 | 5/1972 | Manizza | 229/41 B |
| 3,692,228 | 9/1972 | Spiegel | 229/29 F |
| 3,899,119 | 8/1975 | Roccaforte | 229/33 |
| 4,228,945 | 10/1980 | Wysocki | 229/30 |

*Primary Examiner*—Herbert F. Ross
*Attorney, Agent, or Firm*—Evelyn M. Sommer

[57] ABSTRACT

A carton, and a blank for forming the same, is disclosed which is adapted for storing and heating a food product such as a pizza. The carton includes a bottom wall defined by a bottom panel and closure panel, disposed in abutting and coplanar relationship. The bottom panel is provided with a plurality of venting apertures. In use, the closure panel is rotated away from the bottom panel such that a pair of elevator panels extend therebetween. The closure panel thereby defines a base for supporting the bottom panel in spaced relationship to the bottom of the oven. Further, the venting apertures are uncovered allowing moisture to escape from the carton while the pizza is being heated.

12 Claims, 4 Drawing Figures

VENTING CARTON AND BLANK THEREFOR

BACKGROUND OF THE INVENTION

A pizza is a food product having a crust made from a leavened dough base, with the upper face of the crust covered with a tomato paste and a meltable cheese. The pizza may be prepared and frozen by a food processor, packed in a cardboard box and sold, at retail, in its frozen state. The user may simultaneously unfreeze and heat the pizza in a microwave oven. A microwave oven produces radio frequency energy which excites the molecules of the pizza and internally and rapidly heats it.

The user may, in some cases, remove the pizza from the cardboard container before placing the pizza in the oven. However, this may be difficult since the pizza crust may be partially frozen to the cardboard. More importantly, after the pizza is removed from its container and placed in the oven, the crust may flake or the cheese may run over the rim of the pizza, requiring the oven to be cleaned. Since one of the major attractions of frozen pizza to the user is its convenience, the requirement to clean the microwave oven seriously detracts from that convenience.

Alternatively, the user may retain the pizza in the cardboard container and place both in the microwave oven if the container is small enough to fit in the oven, for example, if the container contains a slice of a large pizza or a small pizza. Retaining the pizza in the container during heating prevents soiling of the oven and permits the pizza to become unfrozen from the cardboard.

However, various problems may occur when the pizza is heated in its cardboard container. The pizza, especially if it has been frozen, contains a considerable amount of moisture. That moisture, under the rapid heating of the microwave oven, may turn into steam vapor. If the vapor cannot rapidly escape from the container, it may make the pizza moist and soggy, contrary to its desired property of crispness. In addition, if the bottom crust of the pizza is left in contact with the cardboard during heating, the crust may not be heated sufficiently or it may be heated unevenly or it may become soggy instead of becoming crisp.

U.S. Pat. No. 3,876,131 entitled "Wedge Shaped Carton", which names William Tolaas as inventor and Hoerner Waldorf Corporation as assignee, shows a carton adapted to hold a frozen slice (wedge) of pizza. The carton has apertures in its bottom panel to permit the circulation of air during heating. The apertures are sealed by a strip of plastic film which is removed prior to heating. The carbon bottom, during heating, is kept above the metal panel of the oven by means of the carton's side walls which extend below the level of the carton bottom.

Accordingly, it is an object of the subject invention to provide a paperboard container for a pizza, or a slice thereof, which is to be heated in a microwave oven, which container permits the pizza to be heated while in the container, permits even heating of the crust without the crust sticking to the container and permits minimal contact between the pizza crust and the carton.

It is a further object of the subject invention to provide such a container which may be partially opened by the user to vent its contents, prior to heating the pizza, to leave only a minimal amount of paperboard material in contact with the bottom crust of the pizza.

It is another object of the subject invention to provide such a container which does not require that a plastic film be removed from apertures before the pizza is heated.

It is still a further object of the subject invention to provide such a container which may be easily and readily manipulated by the user to vent the container before the pizza is heated.

It is still another object of the present invention to provide such a container which may be produced employing conventional machinery and methods and using a one-piece paperboard blank.

SUMMARY OF THE INVENTION

In accordance with these and other objects, the subject invention provides for a carton and a blank for forming the same which is adapted for storing and heating a food product such as a pizza. The enclosed carton includes opposed top and bottom walls disposed in spaced apart, parallel relationship. A tubular side wall extends between and is hingedly connected to the side edges of the top and bottom walls. The bottom wall is defined by a bottom panel and a closure panel which are disposed in adjacent, face-to-face relationship, with the closure panel being located externally of the carton. The bottom panel includes a rectangular vent panel defined by a combination of a first fold line and an intermittent U-shaped cut line. The vent panel further includes a second fold line disposed parallel to the first fold line for dividing the vent panel into a support panel and a first elevator panel. The bottom panel is provided with at least one aperture of sufficient size to allow moisture to escape from the carton while the pizza is being heated and to minimize contact between the carton and the pizza crust.

The closure panel is provided with a pair of parallel fold lines defining a second elevator panel. The support panel of the bottom panel is adhesively connected to the closure panel. The bottom panel is also adhesively connected to the closure panel along the other side edge of each panel. Preferably, a lifting tab is provided in the closure panel.

In use, pizza is introduced into the carton by the producer and the side wall is sealed for storage and shipment. Prior to heating, the user tears the intermittent score lines defining the vent panel enabling the closure panel to be rotated away from the bottom panel with the elevator panels extending therebetween. By this arrangement, the venting aperture is uncovered and the closure panel defines a base for supporting the bottom panel in spaced relationship to the base. In addition, the rotation of the vent panel out of the plane of the bottom panel defines another venting aperture. The closure panel thereby functions as both a cover for the venting aperture during storage and shipment and as a support base during heating.

Further objects and advantages of the subject invention will become apparent from the detailed description taken in conjunction with the following drawings in which:

DETAILED DESCRIPTION OF THE PREFERRED EMBODIMENT

Figure 3:
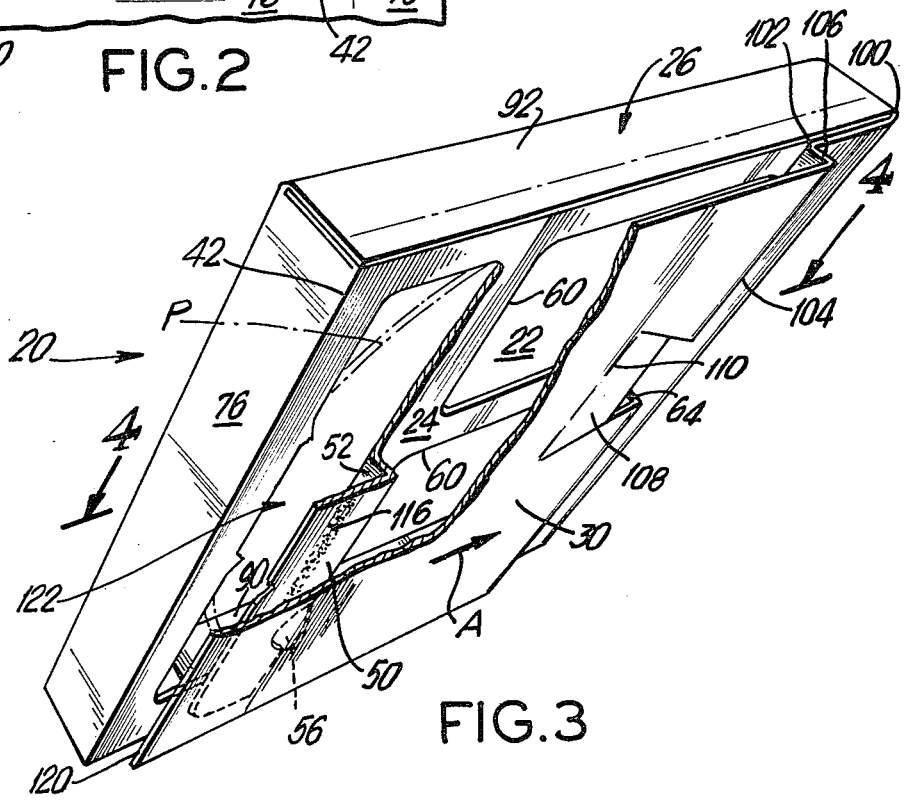
FIG. 3 is a perspective view of the new and improved carton of the subject invention, erected from the blank of FIG. 1 and illustrated in the open position.
Figure 4:
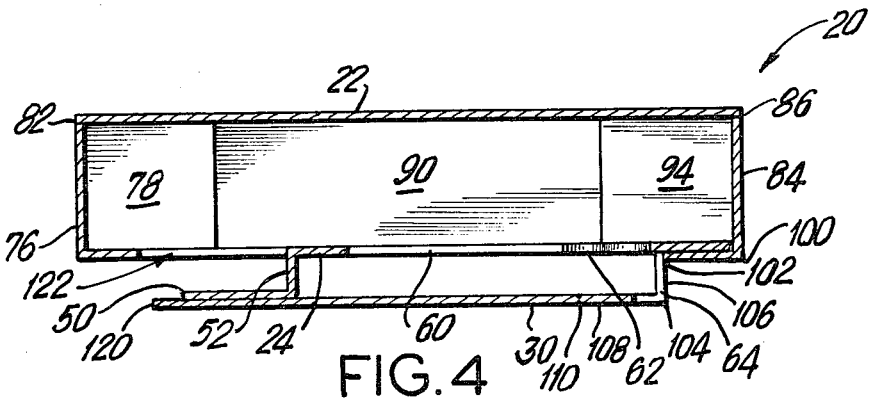
FIG. 4 is a cross sectional view taken along the line 4—4 in FIG. 3 of the new and improved carton of the subject invention.

Referring to FIGS. 3 and 4, there is illustrated the erected carton 20 of the subject invention. The carton includes opposed top and bottom panels 22 and 24, respectively, disposed in spaced apart parallel relationship. A tubular side wall 26 defined by a plurality of side and end panels, extends between and is hingedly connected to the side edges of the top and bottom panels. In accordance with the subject invention, a closure panel 30 is adhesively connected to the bottom panel 24. In use, during shipment and storage, closure panel 30 is in adjacent to and abutting relationship with the bottom panel 24 thereby sealing the venting apertures provided in the latter. Prior to heating, the closure panel 30 is rotated into spaced relationship to the bottom panel 24, as illustrated in FIGS. 3 and 4, thereby providing a support base for raising the bottom panel off the bottom of the oven. By this arrangement, the venting apertures in the bottom panel are opened enabling moisture to escape from the carton. The closure panel 30 thereby has a dual function of sealing the carton during shipment and providing a support base during heating.

Figure 1:
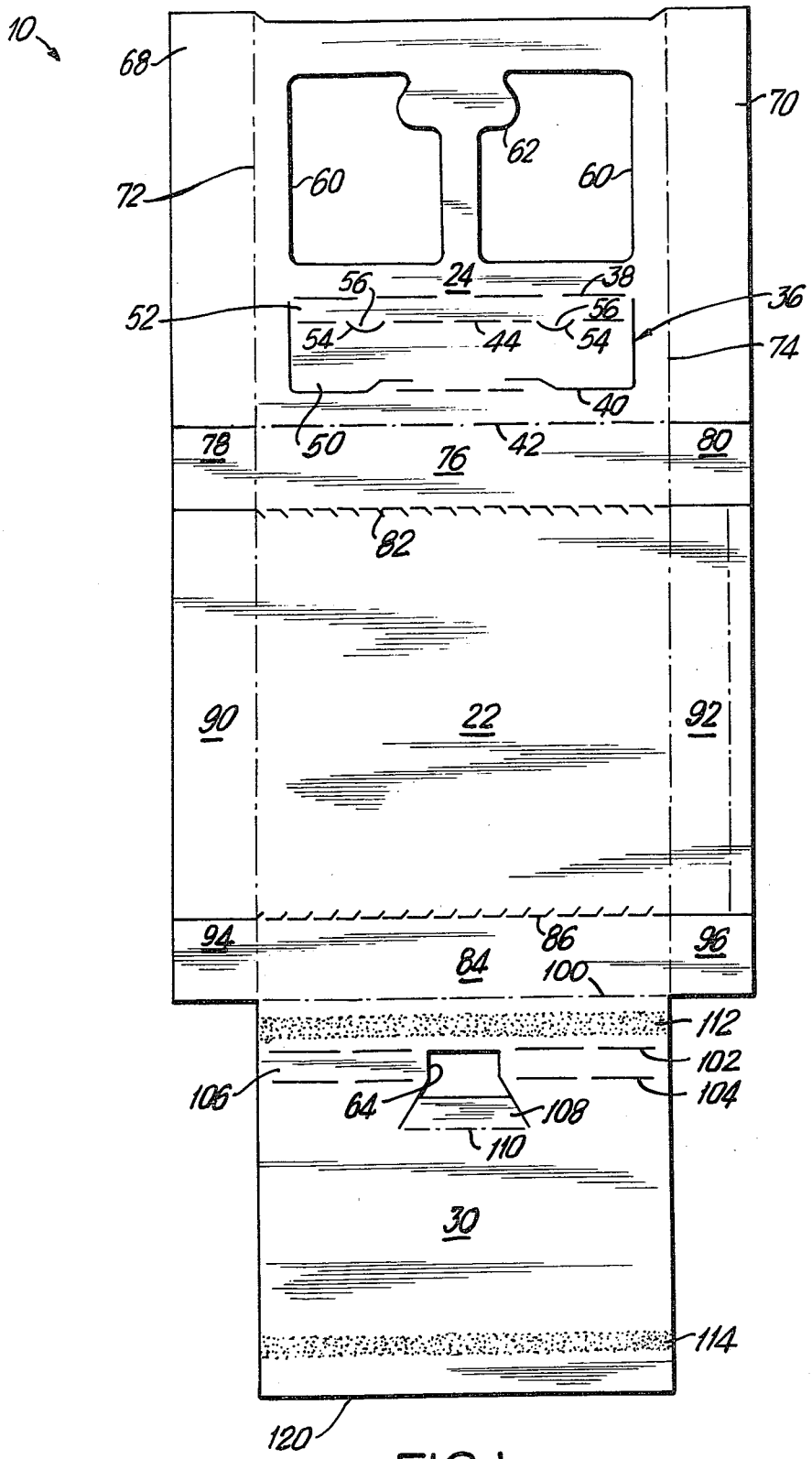
FIG. 1 is a top plan view of a blank for forming the new and improved carton of the subject invention.

Referring to FIG. 1, the blank for forming the carton of the subject invention is more particularly illustrated. Blank 10, preferably formed from an ovenboard-type material, includes a generally rectangular bottom panel 24 having a vent panel 36 formed therein. Vent panel 36 is defined by a combination of a first fold line 38 and a generally U-shaped, intermittent cut score line 40. Cut score line 40 extends away from side edge 42 of bottom panel 24. Vent panel 36 includes a second fold line 44 disposed parallel to first fold line 38. Second fold line 44 divides vent panel 36 into a support panel 50 and an elevator panel 52. Second fold line 44 preferably include a pair of semi-circular cut segments 54 which define semi-circular tabs 56 extending into support panel 50. Tabs 56 add structural rigidity to the open carton as more fully described hereinafter.

Bottom panel 24 is further provided with a pair of venting apertures 60 for minimizing the contact of the pizza crust with the bottom panel to permit vapors to escape from the carton during heating. In the illustrated embodiment, a reinforcing segment 62 is provided which in the erected carton is aligned with an opening 64 provided in closure panel 30. Reinforcing member 62 is provided to insure the complete sealing of the carton.

Figure 2:
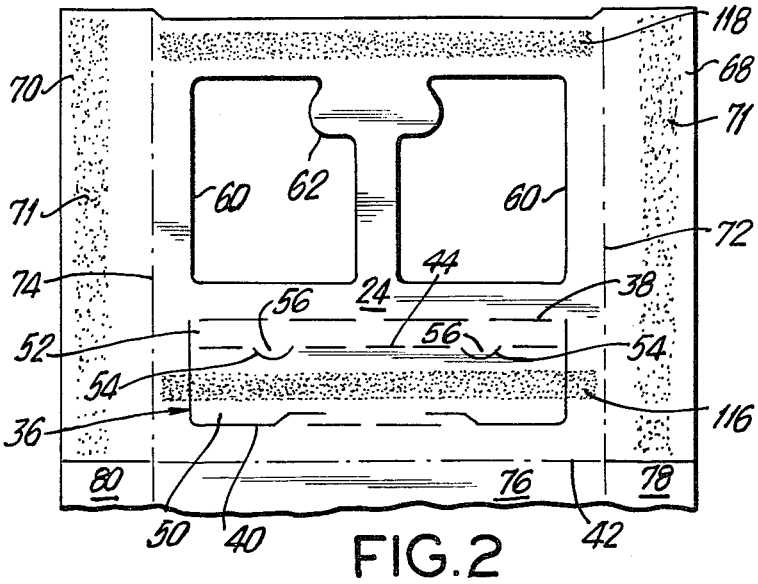
FIG. 2 is a partial plan view of the reverse side of the blank of FIG. 1.

A pair of opposed end flaps 68 and 70 are hingedly connected to opposed side edges of bottom panel 24 along fold lines 72 and 74, respectively. Preferably, an adhesive 71 is provided on the reverse side of end flaps 68 and 70, as illustrated in FIG. 2. A first side panel 76 is hingedly connected to bottom panel 24 along fold line 42. A pair of glue flaps 78 and 80 are hingedly connected to first side panel 76 along fold lines 72 and 74.

A generally rectangular top panel 22 is hingedly connected to first side panel 76 along a cut score line 82. Second side panel 84 is connected to the opposed edge of top panel 22 along cut score line 86. Cut score lines 82 and 86 are preferably tearable to enable the top wall 22 to be readily removed from the carton after heating of the contents has been completed. A pair of end flaps 90 and 92 are connected to the remaining side edges of top wall 22 along fold lines 72 and 74, respectively. A pair of glue flaps 94 and 96 are connected to opposed side edges of the second side panel 84 also along fold lines 72 and 74.

Closure panel 30 is hingedly connected to second side panel 84 along fold line 100. Preferably, closure panel 30 is generally rectangular in configuration having dimensions substantially conforming to the dimensions of bottom panel 24. Closure panel 30 includes a pair of fold lines 102 and 104 disposed parallel to and spaced from fold line 100. Fold lines 102 and 104 function to define a second elevator panel 106 having a width substantially equal to first elevator panel 52. An opening 64 is provided in closure panel 30 to facilitate the opening of the carton. Opening 64 is spaced from fold line 100 and is contiguous with elevator panel 106. A tab segment 108 is hingedly connected to closure panel 30 along a side edge 110 of opening 64. Tab 108 is provided to facilitate grasping of the closure panel during opening of the carton. To aid in assembling the carton, a pair of glue strips 112 and 114 are provided adjacent to the opposed side edges of the closure panel.

Preferably, the carton 20 is partially erected by the carton manufacturer from the blank 10 to form a tubular configuration. The food producer may then load the carton with a food product, such as pizza and seal the end panels to define an enclosed carton. Accordingly, to partially erect the carbon from blank 10, side panels 76 and 84 are rotated into perpendicular relationship with the top wall 22. Thereafter, bottom panel 24 is rotated about fold line 42 until the remaining free edge thereof is in contact with fold line 100 of second side panel 84. Closure panel 30 is then rotated about fold line 100 into abutting relationship with bottom panel 24. The closure panel 30 is adhesively connected to bottom panel 24 along glue strips 112 and 114. Glue strip 114 is aligned with support panel 50 of vent panel 36 and is adhesively connected thereto, in the area 116 shown in FIG. 2, which illustrates the reverse side of the blank 10. Preferably, to insure that the vent panel 36 is not inadvertently torn, the adhesive connection to the closure panel should extend beyond the boundaries of the vent panel 36. The opposed end of closure panel 30 is connected to the bottom panel 24 adjacent the free end thereof along glue strip 112. Glue strip 112 is aligned with area 118 as shown in FIG. 2. In this configuration, the carton can be collapsed into an essentially two dimensional multi-ply configuration for shipping to the producer.

When the producer desires to load the carton 20, the top and bottom panels 22, 24 are rotated into spaced apart relationship defining an open tube. The pizza product P may then be loaded therein with the bottom crust resting on the bottom panel 24. The carton is closed and sealed by folding the end flaps (68, 70, 90, 92) into overlapping relationship, perpendicular to the top and bottom panels. The end flaps are adhesively connected via glue strips 71 provided on end flaps 68 and 70. The carton may then be shipped to the retailer in a closed, sealed condition.

The subject carton while presenting a fully sealed outer surface can be readily transformed into a venting carton having a support base. To prepare for heating, the user can rotate closure panel 30 into spaced relationship with the bottom panel 24. More particularly, to rotate closure panel 30 away from bottom panel 24, the free edge 120 of the closure panel is lifted in order to tear intermittent cut score line 40. Lifting edge 120 functions to tear score line 40 because of the adhesive connection 116 between closure panel 30 and the support panel 50. In the preferred embodiment, the adhesive connection which extends beyond the ends of support panel 50, is simultaneously torn. By grasping tab 108, the closure panel is then rotated, in the direction of arrow A, in FIG. 3. The rotation continues downwardly and laterally until elevator panels 52 and 56 are disposed parallel to each other and perpendicular to the bottom and closure panels. As closure panel 30 is moved away from bottom panel 24, vent panel 36 is rotated out of the plane of the bottom panel, thereby defining another venting aperture 122, as illustrated in FIG. 3.

As illustrated in FIG. 4, in this configuration, closure panel 30 defines a base for supporting the carton 20 such that the bottom panel thereof is spaced from the bottom of the oven. As can be appreciated, the venting apertures 60 and 122 provided in the bottom panel, are now unobstructed to permit the escape of moisture from the package.

As discussed above, preferably, second fold line 44 of vent panel 36 is configured to include semi-circular tabs 56. As illustrated in FIG. 3, when the closure panel 30 is rotated into the open position, the semi-circular tabs remain in parallel relationship to first elevator panel 52. Accordingly, the free ends of the tabs 56 become frictionally engaged with the adjacent surface of closure panel 30. This frictional engagement functions to stabilize the carton in the open position and prevents its inadvertent collapse. Once the pizza has been fully heated, it may be removed from the box by either opening the end panels or by tearing the top wall away from the carton 20 along cut score lines 82 and 86.

Accordingly, there has been provided a new and improved carton 20 and a blank 10 for forming the same, adapted for storing and heating a food product such as pizza. The carton consists of opposed top and bottom walls disposed in spaced apart parallel relationship. A tubular side wall 26 extends between and is hingedly connected to the side edges of the top and bottom walls. The bottom wall is defined by a bottom panel 24 and a closure panel 30 disposed in abutting relationship. Bottom panel 24 includes a rectangular vent panel 36 defined by a combination of a first fold line 38 and an intermitten U-shaped cut line 40. The rectangular vent panel also includes a second fold line 44 disposed parallel to the first fold line for dividing the vent panel into a support panel 50 and a first elevator panel 52. The bottom panel also includes at least one venting aperture 60 formed in the remaining area of the bottom panel. The bottom panel is adhesively connected to the closure panel along the support panel 50. The bottom and closure panels are also adhesively joined adjacent the opposed edge of each panel. Closure panel 30 is provided with a pair of parallel fold lines 102, 104 defining a second elevator panel 106.

When the food product within the carton 20 is to be heated, intermittent score line 40 defining a portion of the vent panel 36 is broken such that the closure panel may be rotated downwardly, away from the bottom panel, with the elevator panels extending therebetween. By this arrangement, the venting aperture provided in the bottom panel is uncovered and a base is defined for supporting the bottom panel in spaced relationship to the bottom of the oven. The rotation of the vent panel 36 out of the plane of the bottom panel functions to define another venting aperture 122. Thus, the closure panel 30 functions to seal the carton in the closed configuration and when opened, functions to define a base for supporting the carton. The venting apertures provided in the carton allow moisture to escape during heating.

It is to be understood that while the subject invention has been described with reference to a preferred embodiment, it is apparent that other changes and modifications could be made therein by one skilled in the art without varying from the scope or spirit of the subject invention as defined by the appended claims.

What is claimed is:

1. A carton adapted for storing and heating a food product such as a pizza, said carton comprising:

opposed top and bottom walls disposed in spaced apart, parallel relationship; and a tubular side wall extending between and hingedly connected to the side edges of said top and bottom walls to define an enclosed carton, said bottom wall being defined by a bottom panel and closure panel disposed in abutting relationship to said bottom panel and, said closure panel being located externally of said carton, said bottom panel including a rectangular vent panel disposed adjacent to and spaced from one side edge of said bottom panel and defined by a combination of a first fold line and an intermittent U-shaped cut line, said U-shaped cut line extending away from said one side edge, said rectangular vent panel including a second fold line disposed parallel to said first fold line and dividing said vent panel into a support panel and a first elevator panel, said bottom panel further including at least one venting aperture formed in the remaining area of said bottom panel and with said support panel of said bottom panel being adhesively connected to said closure panel adjacent one side edge thereof, and with said bottom panel being further adhesively connected to said closure panel along a line adjacent the other side edge of each of said panels respectively, and with said closure panel further including a pair of fold lines disposed parallel to and spaced from said other side edge of said closure panel and defining a second elevator panel whereby when said food product is to be heated within said carton, said intermittent score line defining a portion of said venting panel is broken such that said closure panel may be rotated downwardly away from, and laterally to said bottom panel, with said elevator panels extending therebetween thereby uncovering said one venting aperture and defining a base for supporting said bottom panel in spaced relationship therewith, and with said vent panel being rotated out of the plane of said bottom panel to define another venting aperture.

2. A carton as recited in claim 1 wherein said closure panel further includes an opening, disposed adjacent said other edge thereof, and contiguous with said second elevator panel, said opening to facilitate the rotation of said closure panel away from said bottom panel.

3. A carton as recited in claim 2 wherein said closure panel further includes a tab hingedly connected to said closure panel along a side edge defined by said opening.

4. A carton as recited in claim 1 wherein said second fold line, dividing said vent panel into said support panel and said first elevator panel, includes at least one semi-circular section, defining a semi-circular tab projecting into said support panel such that when said closure panel is rotated away from said bottom panel, with said first elevator panel extending therebetween, said semi-circular tab becomes frictionally engaged with said closure panel thereby stabilizing said carton in the open configuration.

5. A carton as recited in claim 1 wherein said adhesive connection between said bottom and closure panels, along said support panel, extends beyond the boundary of said support panel to prevent the inadvertent tearing of said vent panel.

6. A carton as recited in claim 1 formed from a one piece paperboard blank.

7. A one piece paperboard blank for forming a carton adapted for storing and heating a food product such as a pizza, said blank comprising:

a generally rectangular bottom panel, said bottom panel including a rectangular vent panel disposed adjacent to and spaced from one side edge of said bottom panel and defined by a combination of a first fold line and an intermittent U-shaped cut line, said U-shaped cut line extending away from said one side edge, said rectangular vent panel including a second fold line disposed parallel to said first fold line and dividing said vent panel into a support panel and a first elevator panel, said bottom panel further including at least one venting aperture formed in the remaining area of said bottom panel;

a pair of end flaps hingedly connected to the side edges of said bottom panel disposed perpendicular to said one side edge;

a side panel hingedly connected to said one side edge of said bottom panel;

a generally rectangular top panel hingedly connected to the opposed side edge of said side panel;

a second side panel hingedly connected to the opposed side edge of said top panel;

a pair of end flaps hingedly connected to the remaining side edges of said top panel; and a closure panel hingedly connected to the opposed side edge of said second side panel, said closure panel including a pair of fold lines disposed parallel to and spaced from the hinged connection to said side panel, said parallel fold lines defining a second elevator panel.

8. A blank as recited in claim 7 wherein said second fold line, dividing said vent panel into said support panel and said first elevator panel, includes at least one semi-circular cut section defining a semi-circular tab projecting into said support panel.

9. A blank as recited in claim 7 wherein said closure panel further includes an opening disposed adjacent to and spaced from said hinged connection to said second side panel, said opening being contiguous with said second elevator panel.

10. A blank as recited in claim 7 wherein said closure panel further includes a tab hingedly connected to said closure panel along a side edge defined by said opening.

11. A blank as recited in claim 7 wherein said closure panel is generally rectangular in configuration and has dimensions substantially corresponding to the dimensions of said rectangular bottom panel.

12. A blank as recited in claim 7 wherein the width of each of said elevator panels is substantially equal.

* * * * *